United States Patent [19]

Herb et al.

[11] 4,120,453

[45] Oct. 17, 1978

[54] AIR DISTRIBUTION UNIT

[75] Inventors: Carl C. Herb, Camillus; Robert A. Rose, Liverpool, both of N.Y.

[73] Assignee: Carrier Corporation, Syracuse, N.Y.

[21] Appl. No.: 792,388

[22] Filed: Apr. 29, 1977

[51] Int. Cl.[2] ..... F24F 11/04

[52] U.S. Cl. ..... 236/49; 137/486; 236/80 R

[58] Field of Search ..... 236/49, 80 R, 82; 137/486

[56] References Cited

U.S. PATENT DOCUMENTS

| | | | |
|---|---|---|---|
| 3,719,321 | 5/1971 | McNabney | 236/49 |
| 3,806,027 | 4/1974 | Ginn et al. | 236/49 |
| 3,841,394 | 10/1974 | Van Becelaere | 236/49 X |

*Primary Examiner*—William E. Wayner

*Attorney, Agent, or Firm*—J. Raymond Curtin; Barry E. Deutsch

[57] ABSTRACT

An air distribution unit for discharging conditioned air into an area to be conditioned and having a plenum chamber for receiving conditioned air and an outlet in communication with the plenum chamber and with the area being conditioned. A damper is employed to regulate the flow of conditioned air from the plenum chamber to the outlet with the damper being responsive to a thermostat to regulate the quantity of air discharged into the area in accordance with the temperature requirements thereof. The distribution unit includes an override control to maintain the flow of air through the damper at a constant predetermined rate irrespective of the temperature requirements in the area, the override control becoming operable when the damper has initially discontinued flow of conditioned air into the area in response to sensed temperature.

3 Claims, 2 Drawing Figures

AIR DISTRIBUTION UNIT

BACKGROUND OF THE INVENTION

This invention relates to an air distribution unit for delivering conditioned air into an area or space, and more particularly relates to a control for maintaining the flow of conditioned air into the area at a minimum predetermined rate irrespective of the temperature requirements of the space.

The utilization of air conditioning air distribution units to supply conditioned air from a central source thereof to offices, schoolrooms, and other similar spaces or areas in multi-room buildings has become increasingly prevalent. Such distribution units are typically located in the ceiling of the rooms or areas being conditioned, or on the floor thereof adjacent the windows. The flow of conditioned air from the units is generally regulated by operation of suitable damper means controlled by a thermostat sensing the temperature of the space being conditioned. Thus, as the temperature of the space deviates to a greater degree from a predetermined set point, a greater quantity of conditioned air is discharged into the area. Conversely, when the temperature in the space being conditioned approaches the set point, the quantity of conditioned air discharged thereinto is reduced.

An air distribution unit of the type suitable for installation in a ceiling that has met with widespread commercial success is disclosed in U.S. Pat. No. 3,143,292, issued Aug. 4, 1964, and assigned to the same assignee as the assignee hereof.

Many of the units of the type disclosed in the aforecited patent have included means to substantially terminate the flow of conditioned air into the space when the temperature therein equals the desired set point. However, many modern building codes require that air distribution units maintain the flow of a minimum quantity of air into a space to insure adequate ventilation. Thus, an air distribution unit having the capability to substantially terminate the flow of conditioned air is not satisfactory in meeting the requirements of the above building codes.

The particular unit disclosed in the above-cited patent includes a control member having a fixed orifice to insure a minimum quantity of air flow into the space being conditioned. However, it has been found that the fixed orifice, due to its relatively small size, can become clogged by dirt or other foreign bodies to thereby prevent the required minimum flow of conditioned air for ventilating purposes. The maintenance required to insure that the orifice remains unclogged is both time consuming and relatively expensive. It is further desirable to obtain the minimum flow of conditioned air from the unit without adversely affecting the aerodynamic characteristics of the unit.

SUMMARY OF THE INVENTION

It is, therefore, an object of the present invention to have an air distribution unit with suitable control means whereby a minimum predetermined flow of air into the space being conditioned is maintained irrespective of the temperature requirements in said space.

It is another object of this invention to maintain a minimum flow of conditioned air for ventilating purposes from an air distribution unit without introducing maintenance problems.

It is a further object of this invention to maintain a minimum flow of conditioned air from an air distribution unit without adversely affecting the air delivery characteristics thereof.

These and other objects of the present invention are attained in an air distribution unit for discharging conditioned air into an area to be conditioned and including means defining a plenum chamber for receiving conditioned air, means defining an outlet from the plenum chamber into the area to be conditioned, and a damper arrangement to regulate the flow of conditioned air from the plenum chamber to the outlet means. The unit includes control means including thermostatic means to vary the operation of the damper means in accordance with the sensed temperature of the air to be conditioned whereby a greater quantity of air is introduced into the area when the temperature thereof is substantially greater than a predetermined set point, with a lesser quantity of air being introduced into the area as the sensed temperature approaches the set point. The control means further includes override means operable when the damper means substantially terminates the flow of air into the area being conditioned in response to said thermostatic means to maintain a minimum flow of conditioned air from the plenum chamber to the outlet means irrespective of the sensed temperature.

DESCRIPTION OF THE PREFERRED EMBODIMENT

Figure 1:
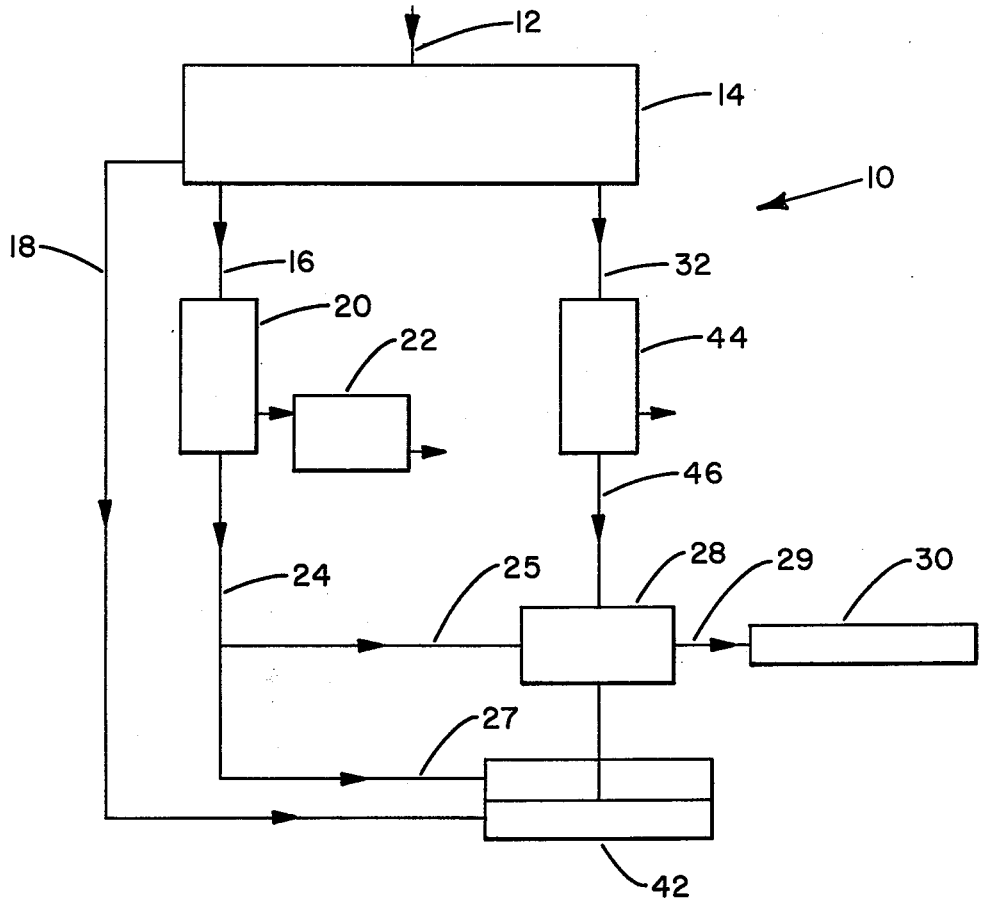
FIG. 1 is a schematic diagram illustrating a control arrangement for the air distribution unit of the instant invention.

Referring now to the drawings, there is shown an air distribution unit illustrating a preferred embodiment of the present invention. In referring to the several figures of the drawings, like numerals shall refer to like parts.

Figure 2:
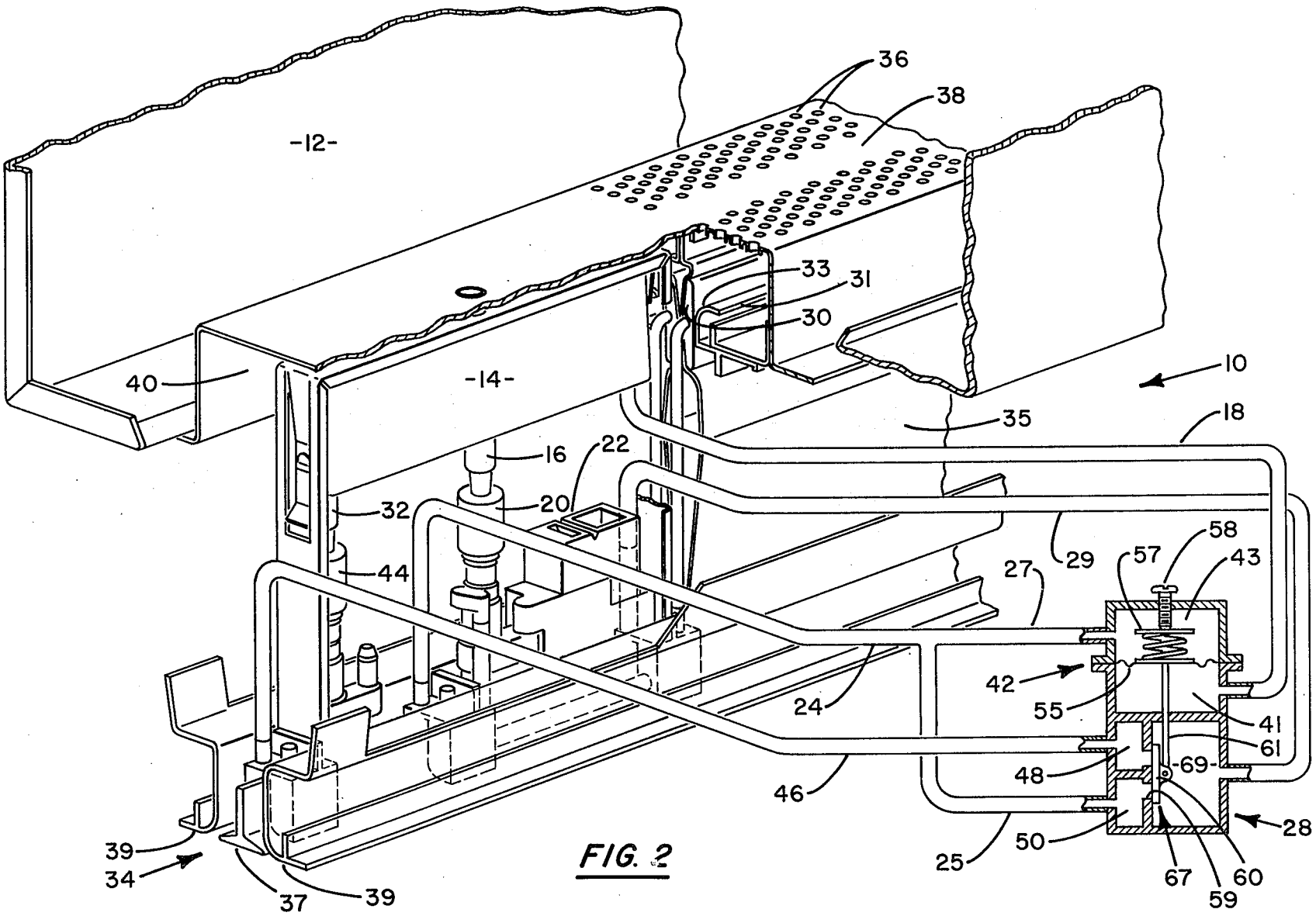
FIG. 2 is a perspective view, somewhat in schematic, of an air distribution unit and a control therefor in accordance with the teachings of the present invention.

Referring particularly to FIG. 2, there is illustrated a preferred embodiment of an air distribution unit 10 in accordance with the instant invention. Conditioned air is delivered from a central source thereof (not shown) to a plenum chamber 12 of the air distribution unit. The conditioned air flows through openings 36 provided in air distribution plate 38 to distribute the air from the plenum chamber 12 into a distribution chamber 40 defined by the top and side walls of distribution plate 38. A damper arrangement illustrated as an inflatable bellows 30 regulates the flow of air from the distribution chamber 40 to outlet means 34. The manner in which bellows 30 operates shall be more fully explained hereinafter. The conditioned air flows from outlet means 34 to the area or space being conditioned. Details of the air distribution unit shall be more fully described hereinafter.

Referring now to both FIGS. 1 and 2, there is schematically illustrated a control arrangement for air distribution unit 10. A portion of the conditioned air furnished to plenum chamber 12 flows to a filter 14 whereat any foreign bodies entrained therein will be removed. The conditioned air passing through filter 14 is used for controlling the operation of unit 10. The conditioned air thereafter passes through at least one of the conduits 16, 18, or 32 to several other elements of the control system for the unit. The conditioned air flowing from conduit 18 is delivered to a lower chamber 41 of a pressure responsive valve 42. The air passing through conduit 16 flows through a pressure regulator device 20, conduit 24 and thence to parallel conduits 25 and 27. Conduit 25 delivers the air stream to one chamber 50 of a three-way valve 28. Conduit 27 delivers the conditioned air stream to upper chamber 43 of differential valve 42.

Conditioned air passing through conduit 32 flows through a second regulator device 44, a conduit 46 and thence to a second chamber 48 of three-way valve 28. Depending upon the position of three-way valve 28, either the pressure signal delivered through conduit 25, or the pressure signal delivered through conduit 46, will be transmitted to conduit 29 and thence to bellows 30.

A bleed type thermostat 22 regulates the magnitude of the control signal passing through conduit 24. Bleed type thermostat 22 senses the temperature of the air in the area to be conditioned. A bleed type thermostat of the type disclosed herein is more fully illustrated in U.S. Pat. No. 3,595,475, issued in the name of Daniel H. Morton. The details of pressure regulating device 20 and 44 are more fully disclosed in U.S. Pat. No. 3,434,409, issued in the name of Daniel A. Fragnito. Each of the foregoing patents are assigned to the same assignee as the assignee hereof.

Referring again to FIG. 2, the details of a preferred embodiment of the air distribution unit will now be more fully described. However, it should be understood that other air distribution units falling within the spirit and scope of the present invention may be utilized in lieu of the specific unit illustrated herein.

The damper arrangement employed to control the flow of air from distribution chamber 40 to outlet means 34 further includes aligned cutoff plates 31 which are provided with a curved surface 33 for engagement by inflatable bellows 30. By varying the inflation of the bellows, the area between each of the bellows and the cutoff plates may be varied to regulate the quantity of conditioned air discharged into the area or space being conditioned. The manner in which inflation of the bellows is controlled shall be explained in detail hereinafter.

Bellows 30 are adhesively mounted on a central partition assembly comprising opposed generally convex plates 35. The terminal further includes a diffuser triangle 37 provided in spaced relation between outlet member 39. The diffuser triangle and outlet members define outlet means 34 communicating the distribution unit and the area being conditioned. Plates 35 have a V-shaped recessed area so the bellows 30 are completely recessed within the plates when deflated. This provides a large area between the active walls of the bellows and the cutoff plates for maximum air flow therebetween. Further, the recessed bellows provides a smooth surface on plates 35 to minimize air turbulence.

The damper mechanism is disposed a substantial distance upstream from outlet means 34 of the distribution unit to provide sufficient space therebetween to absorb any noise generated by operation of the damper mechanism. For maximum sound absorption, the downwardly extending walls of the unit (not shown) forming air passages in conjunction with plates 35 are lined with a suitable sound absorbing material, such as a glass fiber blanket. Outlet members 39 have outwardly flared portions and are fixed, as by welding, to the walls.

As noted previously, a portion of the conditioned air supplied to plenum chamber 12 is converted into a pressure control signal for transmission to various components of the control system of unit 10. The pressure of the signal transmitted through conduit 18 to lower chamber 41 of differential pressure valve 42 is directly proportional to the pressure of the conditioned air in plenum chamber 12. The pressure signal transmitted through conduit 16 is delivered to pressure regulator 20. The outlet from regulator 20 is in communication with conduit 24. The magnitude of the pressure signal delivered to conduit 24 is controlled by bleed type thermostat 22. Bleed type thermostat 22 is responsive to the temperature of the air in the space being conditioned. As the temperature in the space being conditioned approaches a predetermined set point, the bleed type thermostat functions to increase the magnitude of the pressure signal delivered to conduit 24. Conversely, as the temperature in the space being conditioned varies to a greater degree from the predetermined set point, the thermostat functions to decrease the magnitude of the pressure signal delivered to conduit 24. Conduit 24 is in communication with parallel conduits 25 and 27.

Conduit 27 delivers the pressure signal to upper chamber 43 of differential pressure valve 42. A similar diaphragm pressure responsive member 55 separates upper chamber 43 from lower chamber 41. A spring or similar device 57 is also provided in chamber 43 to generate an additional force acting on the top surface of diaphragm 55, with the force developed by spring 57 being of a predetermined magnitude. Adjustment means 58, shown as an adjustable screw, is associated with spring 57 to vary the spring force acting on the top surface of diaphragm 55.

The pressure signal delivered through conduit 25 is transmitted to one chamber 50 of three-way valve 28. The outlet from chamber 50 is defined by an orifice 59 having a valve member 60 disposed thereover. Valve 60 is connected through valve stem 61 to the lower surface of diaphragm 55. Thus, the position of valve member 60 relative to orifice 59 is controlled by diaphragm 55.

A second pressure signal is delivered to chamber 48 of three-way valve 28 via conduit 46. Valve member 60 also controls the flow of this pressure signal through an orifice 67, defining the outlet from chamber 48. One orifice, either orifice 59 or 67, will be opened to transmit one of the pressure signals to a third chamber 69 of valve 28, from whence the pressure signal will be transmitted via conduit 29 to inflatable bellows 30. The pressure signal transmitted through conduit 46 is controlled by second regulator device 44. Pressure regulating device 44 is preset to develop a pressure signal of a predetermined magnitude in conduit 46. The magnitude of the pressure signal is directly related to a predetermined minimum quantity of conditioned air that must be discharged into the space or area being conditioned to satisfy building code requirements.

OPERATION

The operation of the air distribution unit and the control system related thereto shall now be more fully explained.

Assume that the temperature of the space being conditioned is substantially above the set point. Thus, thermostat 22 will function to provide a minimum magnitude pressure signal through conduits 24, 27 to chamber 43 of differential pressure valve 42. Since lower chamber 41 will have a pressure therein which is directly related to the pressure of the conditioned air in plenum chamber 12, the lower surface of diaphragm 55 will have a greater force acting thereagainst. Thus, the diaphragm will move upwardly causing valve 60 to open orifice 59. Orifice 67 will be in a closed position. The pressure signal will flow from conduits 24, 25, through open orifice 59 to conduit 29 and thence to inflatable bellows 30. Thus, when the temperature of a space being conditioned is substantially above the set point, the control of the inflatable bellows will be responsive to the sensed temperature. At this time, the quantity of conditioned air furnished to the space will vary in accordance with the temperature changes therein as sensed by thermostat 22. The pressure signal will pass from conduits 24 and 25 to conduit 29 so long as the pressure acting against the lower surface of diaphragm 55 maintains valve 60 in a position whereat orifice 59 is open.

As the temperature of the space being conditioned approaches set point, bleed type thermostat 22 will operate to increase the pressure signal in conduit 24. As the pressure signal increases, a greater pressure signal will be furnished through conduit 29 to inflatable bellows 30, thus inflating the bellows to a greater degree to reduce the flow of conditioned air through outlet means 34. As the bellows pressure represented by the pressure in conduit 27 approaches the pressure in chamber 41 of valve 42, substantially all flow of conditioned air from plenum chamber 12 to outlet means 34 is terminated. Since the pressure in chambers 41 and 43 are substantially equal, the additional force generated by spring 57 acting on the top surface of diaphragm 55 will cause valve member 60 to close orifice 59 and open orifice 67. The opening of orifice 67 will allow the transmission of the predetermined magnitude control signal from conduit 46 to conduit 29. By closing orifice 59, the transmission of the pressure signal indicative of the temperature in the space being conditioned is terminated. Thus, a constant magnitude pressure signal will be transmitted to inflatable bellows 30. As indicated previously, the predetermined magnitude pressure signal generated by regulator 44 will cause the bellows to be inflated to a predetermined point, to permit a minimum predetermined quantity of conditioned air to flow from plenum chamber 12 to outlet means 34. The minimum quantity of conditioned air will be used for ventilation purposes to meet building code requirements.

The air distribution unit herein described is readily adaptable to meet different ventilating requirements of different building codes as pressure regulator device 44 can be suitably adjusted to vary the pressure of the control signal generated thereby. The unit and controls are easily adjusted and may be maintained with a minimum amount of maintenance.

While a preferred embodiment of the present invention has been described and illustrated, the invention should not be limited thereto but may be otherwise embodied within the scope of the following claims.

We claim:

1. In an air distribution unit for discharging conditioned air into an area to be conditioned, means defining a plenum chamber for receiving conditioned air, means defining an outlet from said plenum chamber into the area to be conditioned, a damper arrangement including an inflatable bellows to regulate the flow of conditioned air from said plenum chamber to said outlet means, and control means including thermostatic means to vary the inflation of said bellows in accordance with the temperature of the area being conditioned whereby inflation of the bellows is increased to decrease the quantity of air discharged into the area and is decreased to increase the quantity of conditioned air discharged into the area, wherein the improvement comprises:

said control means including override means operable to decrease the pressure in said bellows to reduce the inflation thereof to a predetermined maximum to maintain a minimum flow of conditioned air from said plenum chamber to said outlet means when said inflatable bellows, in response to said thermostatic means, has substantially terminated the flow of air from said plenum chamber to said outlet means, said override means including pressure responsive means operable to transmit a predetermined magnitude control signal to inflate said bellows to a predetermined level; and a three-way valve having a first operating position whereat a pressure signal indicative of sensed area temperature is transmitted to said bellows and a second operating position whereat said predetermined magnitude control signal is transmitted to said bellows.

2. In an air distribution unit for discharging conditioned air into an area to be conditioned, means defining a plenum chamber for receiving conditioned air, means defining an outlet from said plenum chamber into the area to be conditioned, damper means including inflatable bellows to regulate the flow of conditioned air from said plenum chamber to said outlet means, and control means including thermostatic means to regulate the flow of a pressure signal from said plenum chamber to said inflatable bellows, with the magnitude of said signal being substantially equal to the magnitude of the pressure of said conditioned air in said plenum chamber as the temperature in said area approaches a predetermined level to cause said bellows to inflate to substantially terminate the flow of conditioned air from said outlet means to said area, said thermostatic means decreasing the magnitude of said signal to deflate said bellows as the requirement for conditioned air substantially increases wherein the improvement comprises:

valve means responsive to the differential between the pressure of said signal and the pressure of said conditioned air in said plenum chamber to terminate the passage of said signal to said inflatable bellows when the pressure differential decreases below a predetermined magnitude; and means to generate a second pressure signal of a predetermined magnitude, said valve means transmitting said second signal to said bellows when the transmission of said first signal is terminated, to inflate said bellows to a predetermined maximum to maintain a minimum flow of conditioned air from said plenum chamber to said outlet means.

3. An air distribution unit in accordance with claim 4 wherein said valve means is a three-way valve having a first operating position to transmit said first signal and a second operating position to transmit said second signal.

* * * * *